United States Patent [19]

Kerr

[11] 3,968,742

[45] July 13, 1976

[54] PROCESS FOR THE CONCENTRATION OF PIGMENT PRESS CAKE

[75] Inventor: John Hammond Kerr, Wilmington, Del.

[73] Assignee: E. I. Du Pont de Nemours and Company, Wilmington, Del.

[22] Filed: July 30, 1974

[21] Appl. No.: 493,070

[52] U.S. Cl. ..... 100/37; 100/90; 100/121; 100/DIG. 6

[51] Int. Cl.[2] ..... B30B 9/20

[58] Field of Search ..... 100/37, 90, 174, 121, 100/DIG. 6

[56] References Cited

UNITED STATES PATENTS

| | | | |
|---|---|---|---|
| 2,696,148 | 12/1954 | Hornbostel | 100/90 |
| 3,273,492 | 9/1966 | Justus | 100/90 |
| 3,748,686 | 7/1973 | Winterburn et al. | 100/174 |

*Primary Examiner*—Richard E. Aegerter
*Assistant Examiner*—L. Footland

[57] ABSTRACT

A process for the concentration of pigment press cakes including feeding the press cakes to rollers and simultaneously applying a vacuum.

6 Claims, 2 Drawing Figures

PROCESS FOR THE CONCENTRATION OF PIGMENT PRESS CAKE

Figure 1:
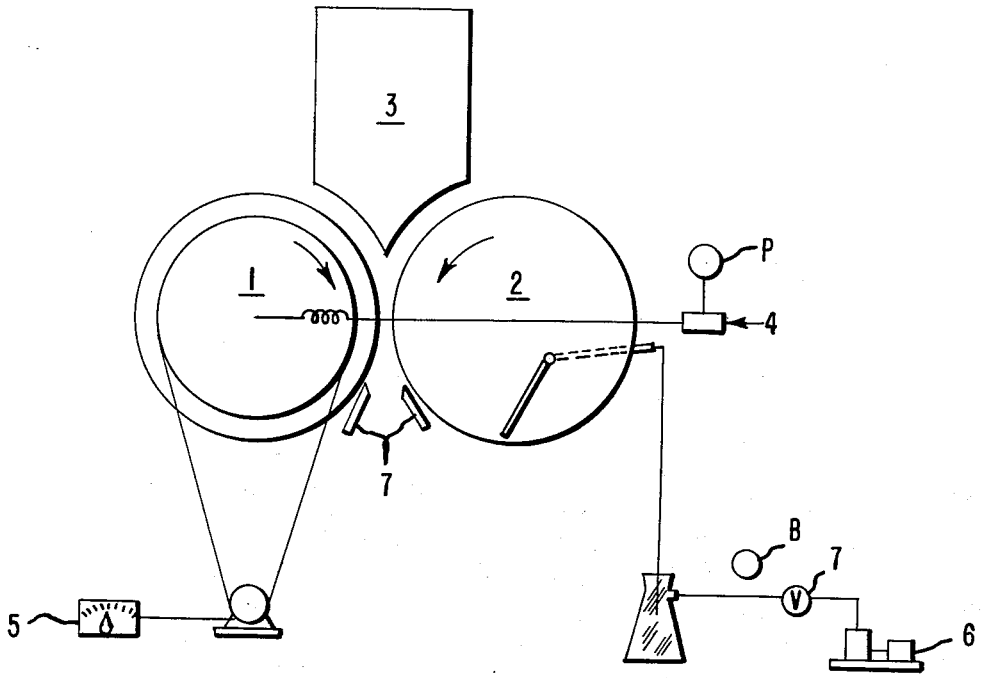

This invention relates to the concentration of filter press cakes of pigmentary material by means of mechanically removing a portion of the filter press cake liquid.

Filter press cakes are residues which are built up on the filter elements of a filtering apparatus, such as frame filter presses, vacuum suction filters, strainers and screws provided with a screen trough. Filter press cakes of pigment obtained by treatment with known apparatus generally have a solids content of 40% or less.

It has been recognized by those skilled in the art that further concentration of said filter press cakes was desirable. Past efforts at further concentration have included the use of heat or high vacuum to reduce the moisture content of the press cake. The use of high vacuum has not been satisfactory because of clogging difficulties associated with the practice of this method. The use of heat to concentrate the press cake has also proved undesirable in some applications because of the adverse effect of the heat upon the finished product.

One attempt to solve this problem is taught in U.S. Pat. No. 3,528,365 issued to List and Noltner on Sept. 15, 1970. List et al. developed a process for mechanically after dehumidifying and further treating filter press cakes of pigments or dispersion dyes which produce press cakes of from 40 to 45% solid content. In the List et al. process a press cake is fed into a truncated cone fitted with a cylindrical screw. Both the cone and screw rotate with the result that the press cake is passed down along a filter layer of the pigment or dye applied to the cone and by means of a vacuum moisture is removed from the press cake. The concentrated press cake is then passed out of the apparatus.

I have discovered a method which results in concentrated press cakes by a less complex procedure than is taught by List et al.

DESCRIPTION OF THE INVENTION

I have discovered that filter press cakes can be concentrated, i.e., dewatered, in an effective, simple and economic manner by simultaneously applying vacuum and pressure to the press cake being treated.

The press cakes produced according to the process of this invention have a number of advantages over conventional press cakes. For example, the tinting strength is increased by as much as 25% in the concentrated press cake; the concentrated press cake is especially suited for use in the manufacture of certain flexographic ink and paint systems where conventional press cakes cannot be employed; the cost of shipping the concentrated press cake is reduced; and the concentrated press cake is easier to disperse, flush and formulate into an oil base resulting in faster and cleaner breakout than its feed press cake.

In addition the physical form of the press cake is altered. The conventional press cake is viscous, is not pourable and, in fact, must be hand-shoveled from the shipping container. The press cake produced by the process of this invention is not viscous but appears to be comprised of chips of pigment and as such is pourable when transferred from the shipping container is desired. This changed physical form enables ink and paint formulators to reduce cost of manufacture because the concentrated press cake is easier to handle, can normally be dispersed easier, can be measured more accurately and results in less waste due to adhesion to the shipping container.

In the practice of this invention low solid press cake from conventional filtration equipment is charged from a vibrating feed hopper onto paired rolls which are dressed with screen and filter cloth. The rolls rotate in opposite directions and the rotation of the rolls causes the low solids press cake to pass into the nip between the rolls. The press cake sheet is then subjected to right angle uniform nip pressure of from about 20 to 60 pounds per linear inch. During the passage through the nip, the press cake not only has the excess liquid forced from the mass, but is also subjected to shear forces which it is believed are partially responsible for the improved quality of the concentrated press cake. The excess liquid is removed through the filter cloth by vacuum. Immediately after, or a short distance from the nip, the concentrated press cake is doctored from the rolls and collected.

Uniform discharge can be achieved by controlling the nip clearance, nip pressure, vacuum and rotation speed of the rolls. The optimum combination of these variables is initially established for the particular characteristics of the press cake. The production rate can increase or decrease with respect to the feed solid level with little or no change in the solid level of the dewatered cake.

REFERRING TO THE DRAWINGS

An apparatus suitable for use in carrying out the process of this invention is illustrated diagrammatically in FIG. 1.

Feed hopper 3 is equipped with a vibrator.

Rolls 1 and 2 are each cylindrical, and made of 316 stainless steel. The rolls are horizontally mounted while Roll 1's axis is stationary and Roll 2 is moveable so that the nip clearance can be adjusted by hydraulic pressure 4 applied on Roll 2.

The rolls are motor driven and rotate in opposite directions such that the top of each roll rotates toward a plane located between the rolls, said plane being perpendicular to a plane though the center axis of the rolls. The direction of rotation of the rolls is shown by the arrows in FIG. 1 on Rolls 1 and 2. The rotation speed is controlled by a voltage regulator 5. The vacuum is supplied by a vacuum pump 6 and amount of vacuum is controlled by valve 7.

The rolls have rows of 1/16 inch by 1/16 inch circumferential grooves on ¼ inch center along the surface of the roll. One eighth inch diameter holes on ¼ inch center are drilled through the roll shell at the bottom of the grooves. The water squeezed from the press cake passes into the grooves and through the holes to the inside of each roll where it is removed by a vacuum system. The vacuum system consists of a syphon tube 8 and a single rotary joint connection in each roll. Each roll is covered by a screen which in turn is covered by a filter cloth to keep the pigment from being forced into the grooves and holes.

Figure 2:
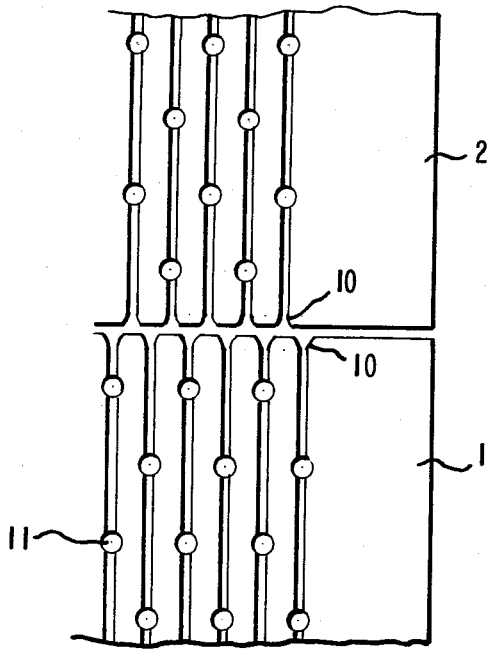

A detailed drawing of Rolls 1 and 2 is presented in FIG. 2.

Circumferential grooves 10, 1/16 inch by 1/16 inch on ¼ inch centers are located on the rolls 1 and 2 in staggered relationship. One eighth in diameter holes 11 spaced at one inch intervals are drilled through the roll shell at the bottom of grooves 10. The water squeezed from the press cake passes into grooves 10 and through holes 11 to the inside of each roll where it is removed by a vacuum system.

After passing through the nip the product adhering to the roll surface is removed by doctor blade 9.

The following examples serve to illustrate the invention but they are not intended to limit it thereto.

EXAMPLE 1

A green shade copper phthalocyanine blue pigment marketed under the name of Du Pont of "BT-436-P" which had been rotary filtered and has a solid level of 30.7%.

The rolls of the apparatus of FIG. 1 were dressed with a nylon screen and a dacron filter cloth (SPD-276-Q). The nip clearance was set at 30 mils and roll rotation speed at 1.06 rpm and a five-inch vacuum was applied.

The 30.7% solid press cake was charged into the apparatus of FIG. 1 and concentrated. The treated press cake has a solids level of 46% by weight.

EXAMPLE 2

A red shade copper phthalocyanine blue pigment marketed under the name of Du Pont of "BT-401-P" having a solid content of 29.5% was dewatered using the apparatus of FIG. 1 as described in Example 1. The dewatered cake obtained has a solids level of 43.0% by weight.

The quality evaluations were tabulated as follows:

The concentrated press cakes of Examples 1 and 2 are compared to the press cakes from which they were derived to determine the effect of the process of this invention on tinctorial properties in various vehicle systems. In each comparison an equivalent solids dry weight of starting press cake is incorporated in the vehicle to compensate for the higher concentration of solids in the press cakes produced by the process of this invention. Results are stated in terms of "=" meaning that the tinctorial properties of the concentrated press cake is equal to the starting press cake; "% strong" meaning that tinctorial properties of the concentrated press cake is superior to the starting press cake; "% weak" meaning that the tinctorial properties of the concentrated press cake is inferior to the starting press cake. The results are reported in the table below.

| Relative Tinctorial Strength | | |
|---|---|---|
| | Concentrated Press Cake of Example 1 | Concentrated Press Cake of Example 2 |
| Flushed (Lawter's heatset vehicle) | = | = |
| Textile Ink o/w | = | = |
| Textile Ink w/o | 2% weak | 2% weak |
| Aqueous Acrylic Flexo Ink | 20% strong | 15% strong |
| Aqueous Amberol Flexo Ink | 15% strong | 5% strong |
| Polyvinyl Acetate Emulsion Paint | 5% strong | = |

In the above-reported evaluation the ink and paint formulations are typical of formulations used in the trade and the compositions of said formulations are described below.

The flushed formulation contains 30% by weight pigment, 9% high boiling point solvent and the remainder heatset vehicle.

The Textile ink o/w ink contains a self cross-linking acrylic binder, an alkyd resin, a surfactant such as the sodium salt of lauryl alcohol sulfate, textile spirits, water and 0.14% by weight of pigment.

The Textile w/o ink contains a short tailed valic alkyl resin, Ethyl Cellulose T50, Melamine formaldehyde resin, xylol, sodium condensed naphthalene sulfonic acid and 0.14% by weight of pigment.

The Aqueous Acrylic flexo ink contains an acrylic resin such as Aqus Hyde 100, ethanol and water and 10% by weight of pigment.

The Amberol flexo ink contains Amberol 750, water and 17.5% by weight pigment.

The Polyvinyl acetate emulsion paint contains a copolymer of vinyl acetate with a dibutyl ester of maleic or fumaric acid, a surfactant and water.

EXAMPLE 3

A quinacridone red pigment marketed by Du Pont under the name of "RT-763-P" was dewatered as EXAMPLE 1 from 38.5 to 48.6% solid by weight. Its tinting strength is 7.5% stronger in water amberol ink and 5% stronger in Emulsion paint than the dry weight equivalent of the untreated press cake.

EXAMPLE 4

A green copper phthalocyanine pigment marketed under the name of "GT-822-P" was dewatered as Example 1 from 37.4% to 51% by weight solid. It was found the high solid press cake is superior in Cowles dispersibility to the lower solids feeding press cake.

In masstone the higher solid GT-822-P is transparent and higher in gloss. In tinting strength it is 25% stronger versus lower solid feed press cake and in addition the higher solid GT-822-P is more intense than the untreated pigment press cake when drawdowns of equal concentration are compared.

What is claimed is:

1. In a process for using an apparatus which apparatus comprises a pair of rotatable, perforated rolls; means connected to said rolls for rotating said rolls in opposite directions such that the top of each roll rotates toward a plane located between the rolls and said plane being perpendicular to a plane through the center axes of said rolls; means connected to said rolls for adjusting the distance between the rolls; means for feeding pigment press cake between the rolls such that when the rolls are rotated, the press cake is drawn between the rolls; means connected to said rolls for applying vacuum to the interior of the rolls; means connected to said rolls for removing the pigment press cake from the rolls; the improvement comprising using said apparatus, wherein the rolls are circumferentially grooved, mounted horizontally with respect to one another and covered with a porous covering so that only water and dissolved solids can pass through the covering, for performing the process comprising:

a. feeding the pigment press cake between the rolls of said apparatus, b. adjusting the distance between the rolls to provide compression and shear on the pigment press cake, c. applying a vacuum to the interior of the rolls sufficient to cause excess water which is squeezed from the pigment press cake to be drawn into the rolls and eliminated, and d. removing the pigment press cake from the rolls.

2. The process of claim 1 wherein the distance between the rollers is adjusted to provide from 20 to 60 pounds per linear inch pressure.

3. The process of claim 2 wherein the pigment press cake is a copper phthalocyanine pigment press cake.

4. The process of claim 2 wherein the pigment press cake is a quinacridone pigment press cake.

5. The process of claim 1 wherein the pigment press cake is a copper phthalocyanine pigment press cake.

6. The process of claim 1 wherein the pigment press cake is a quinacridone pigment press cake.

* * * * *